US009812048B2

(12) United States Patent
Wu et al.

(10) Patent No.: US 9,812,048 B2
(45) Date of Patent: Nov. 7, 2017

(54) STARTING METHOD OF LIQUID CRYSTAL DISPLAY

(71) Applicant: Shenzhen China Star Optoelectronics Technology Co., Ltd., Guangdong (CN)

(72) Inventors: Yu Wu, Guangdong (CN); Lei Wang, Guangdong (CN)

(73) Assignee: SHENZHEN CHINA STAR OPTOELECTRON ICS TECHNOLOGY CO., LTD., Guangdong (CN)

( * ) Notice: Subject to any disclaimer, the term of this patent is extended or adjusted under 35 U.S.C. 154(b) by 117 days.

(21) Appl. No.: 14/889,335

(22) PCT Filed: Sep. 8, 2015

(86) PCT No.: PCT/CN2015/089171
§ 371 (c)(1),
(2) Date: Nov. 5, 2015

(87) PCT Pub. No.: WO2017/024652
PCT Pub. Date: Feb. 16, 2017

(65) Prior Publication Data

US 2017/0169746 A1 Jun. 15, 2017

(30) Foreign Application Priority Data

Aug. 13, 2015 (CN) ..... 2015 1 0494197

(51) Int. Cl.
*G09G 3/36* (2006.01)
*G09G 3/00* (2006.01)
*G09G 5/395* (2006.01)

(52) U.S. Cl.
CPC ..... *G09G 3/006* (2013.01); *G09G 3/36* (2013.01); *G09G 5/395* (2013.01);
(Continued)

(58) Field of Classification Search
None
See application file for complete search history.

(56) References Cited

U.S. PATENT DOCUMENTS

2007/0171157 A1* 7/2007 Choi ..... G02F 1/13318 345/81
2008/0109765 A1* 5/2008 Chae ..... G09G 5/003 715/866

(Continued)

FOREIGN PATENT DOCUMENTS

CN 1946210 4/2007
CN 101256290 9/2008

(Continued)

OTHER PUBLICATIONS

International Search Report for PCT/CN2015/089171, Completed by the Chinese Patent Office dated May 11, 2016, 13 Pages.

*Primary Examiner* — Kee M Tung
*Assistant Examiner* — Yanna Wu
(74) *Attorney, Agent, or Firm* — Brooks Kushman P.C.

(57) ABSTRACT

A starting method for a liquid crystal display, which includes: after receiving a control command for starting, reading a checking code of a control code for indicating to perform a predetermined screen processing from a flash memory on a photoelectronic board; comparing the checking code read from the flash memory on the photoelectronic board with the checking code stored in a flash memory on a control board; performing the predetermined screen processing based on the read control code for indicating to perform the predetermined screen processing. By adopting the above starting method of the liquid crystal display, starting time of the liquid crystal display is effectively shortened.

9 Claims, 3 Drawing Sheets

(52) U.S. Cl.
CPC ..... *G09G 2320/029* (2013.01); *G09G 2320/0233* (2013.01); *G09G 2330/12* (2013.01); *G09G 2360/127* (2013.01)

(56) References Cited

U.S. PATENT DOCUMENTS

| | | | | |
|---|---|---|---|---|
| 2008/0278426 | A1* | 11/2008 | Chen | G09G 3/3614 345/96 |
| 2011/0249103 | A1 | 10/2011 | Taniguchi | |
| 2013/0050595 | A1* | 2/2013 | Kang | G02F 1/133371 349/15 |
| 2014/0071034 | A1 | 3/2014 | Wang et al. | |
| 2015/0288523 | A1* | 10/2015 | Burghardt | G06F 21/34 726/20 |

FOREIGN PATENT DOCUMENTS

| | | |
|---|---|---|
| CN | 101355639 | 1/2009 |
| CN | 101719356 | 6/2010 |
| CN | 101742061 | 6/2010 |
| CN | 102696067 | 9/2012 |
| CN | 202435503 | 9/2012 |
| CN | 102881265 | 1/2013 |
| CN | 102970601 | 3/2013 |

* cited by examiner

STARTING METHOD OF LIQUID CRYSTAL DISPLAY

CROSS-REFERENCE TO RELATED APPLICATION

This application is the U.S. national phase of PCT Application No. PCT/CN2015/089171 filed on Sep. 8, 2015, which claims priority to CN Patent Application No. 201510494197.3 filed on Aug. 13, 2015, the disclosures of which are incorporated in their entirety by reference herein.

BACKGROUND

Technical Field

The present disclosure generally relates to a display technical field, and more particularly, relates to a starting method which can accelerate starting time of a liquid crystal display (LCD).

Description of the Related Art

Mura is referred to a phenomenon in which a variety of stains are generated by uneven brightness of a display screen, and a possible cause of forming the phenomenon may be a display flaw introduced by an attachment of a color filter on an LCD, or may be a display flaw introduced during manufacturing a liquid crystal screen itself. Existence of the Mura may cause an abnormity display result and the uneven brightness of a picture when a display screen displays an image (especially an image of a large and smooth area), reducing viewing comfort of an audience. Demura refers to a corresponding brightness adjustment performed on an image signal input to different areas of the liquid crystal screen on a premise that information such as a position and a Mura degree of a Mura area is known, so as to increase a uniformity of a picture brightness of an output image, thereby improving viewing experience of the audience.

In the related art, a photoelectronic board (i.e., an X board) and a control board of the liquid crystal display are manufactured independently during a manufacturing process; Demura information (i.e., a code for removing Mura) may generally be stored in a flash memory (Flash) on the photoelectronic board when the liquid crystal leaves a factory; when assembling a finished product of the liquid crystal display, the control board and the photoelectronic board are connected together by using a flexible flat cable. Whenever the liquid crystal display is started, the control board may read all the Demura information from the flash memory on the photoelectronic board, and if the reading fails, the control board is needed to re-read the Demura information from the flash memory on the photoelectronic board. This, however, will cause the starting time of the liquid crystal display to be too long because a length of all the Demura information is relatively large.

SUMMARY

An exemplary embodiment of the present disclosure is to provide a starting method for accelerating starting time of a liquid crystal display, so as to solve a technical problem that the starting time of an existing liquid crystal display is too long.

According to an aspect of an exemplary embodiment of the present disclosure, there is provided a starting method of a liquid crystal display, which includes: (a) after receiving a control command for starting the liquid crystal display, reading a checking code of a control code for indicating to perform a predetermined screen processing from a flash memory on a photoelectronic board of the liquid crystal display; (b) comparing the checking code read from the flash memory on the photoelectronic board with a checking code of a control code for indicating to perform the predetermined screen processing stored in a flash memory on the a control board of the liquid crystal display; (c) if the checking code read from the flash memory on the photoelectronic board is consistent with the checking code stored in the flash memory on the control board, then reading the control code for indicating to perform the predetermined screen processing from the flash memory on the control board; (d) if the checking code read from the flash memory on the photoelectronic board is inconsistent with the checking code stored in the flash memory on the control board, then reading the control code for indicating to perform the predetermined screen processing from the flash memory on the photoelectronic board, and storing the control code for indicating to perform the predetermined screen processing read from the flash memory on the photoelectronic board and the checking code read from the flash memory on the photoelectronic board into the flash memory on the control board; and (e) performing the predetermined screen processing based on the read control code for indicating to perform the predetermined screen processing.

Alternatively, the method further includes: before Step (a), storing the control code for indicating to perform the predetermined screen processing and a corresponding checking code into the flash memory on the photoelectronic board of the liquid crystal display in advance.

Alternatively, the method further may include: storing an initial control code for indicating to perform the predetermined screen processing and a corresponding initial checking code into the flash memory on the control board of the liquid crystal display in advance, wherein when performing the starting method for the first time, Step (b) may include: comparing the checking code read from the flash memory on the photoelectronic board with an initial checking code stored in the flash memory on the control board of the liquid crystal display, wherein Step (c) may include: if the checking code read from the flash memory on the photoelectronic board is consistent with the initial checking code stored in the flash memory on the control board, then reading the initial control code for indicating to perform the predetermined screen processing from the flash memory on the control board, wherein Step (d) may include: (d1) if the checking code read from the flash memory on the photoelectronic board is inconsistent with the initial checking code stored in the flash memory on the control board, then performing Step (d2): reading the control code for indicating to perform the predetermined screen processing from the flash memory on the photoelectronic board; (d3) generating a corresponding checking code according to the read control code for indicating to perform the predetermined screen processing; (d4) comparing the checking code read from the flash memory on the photoelectronic board with the generated checking code; (d5) if the checking code read from the flash memory on the photoelectronic board is inconsistent with the generated checking code, then returning to and performing Step (d2); and (d6) if the checking code read from the flash memory on the photoelectronic board is consistent with the generated checking code, then storing both the control code for indicating to perform the predetermined screen processing read from the flash memory on the photoelectronic board and the checking code read from the flash memory on the photoelectronic board into a flash memory on the control board.

Alternatively, the predetermined screen processing is a processing for removing a screen Mura.

Alternatively, the control code for indicating to perform the predetermined screen processing may indicate a voltage value corresponding to a respective pixel on a display screen of the liquid crystal display, wherein Step (e) may include: adjusting a flip angle of a liquid crystal molecule according to the voltage value corresponding to the respective pixel on the display screen of the liquid crystal display so as to change a display brightness of the respective pixel on the display screen.

According to an aspect of an exemplary embodiment of the present disclosure, there is provided a starting method of a liquid crystal display, which includes: (a) after receiving a control command for starting the liquid crystal display, sequentially reading m pieces of control codes for indicating to perform a predetermined screen processing from a flash memory on a photoelectronic board of the liquid crystal display; and (b) performing the predetermined screen processing based on the read m pieces of control codes for indicating to perform the predetermined screen processing, wherein reading any piece of control code for indicating to perform the predetermined screen processing from the flash memory on the photoelectronic board of the liquid crystal display includes: (a1) reading the one piece of control code for indicating to perform the predetermined screen processing and a first checking code corresponding to the one piece of control code for indicating to perform the predetermined screen processing from the flash memory on the photoelectronic board of the liquid crystal display; (a2) generating a corresponding second checking code according to the read one piece of control code for indicating to perform the predetermined screen processing; (a3) comparing the first checking code with the second checking code; (a4) if the first checking code is inconsistent with the second checking code, then returning to and performing Step (a1); and (a5) if the first checking code is consistent with the second checking code, then taking the one piece of control code for indicating to perform the predetermined screen processing read from the flash memory on the photoelectronic board of the liquid crystal display as one of the m pieces of control code for indicating to perform the predetermined screen processing in Step (c).

Alternatively, the method further includes: before Step (a), dividing the control code for indicating to perform the predetermined screen processing into m pieces; generating corresponding m checking codes respectively with respect to the m pieces of control codes for indicating to perform the predetermined screen processing; and storing the m pieces of control codes for indicating to perform the predetermined screen processing and the generated m checking codes into the flash memory on the photoelectronic board of the liquid crystal display.

Alternatively, the predetermined screen processing may be a processing for removing a screen Mura.

Alternatively, the control code for indicating to perform the predetermined screen processing may indicate a voltage value corresponding to a respective pixel on a display screen of the liquid crystal display, wherein Step (b) may include: adjusting a flip angle of a liquid crystal molecule according to the voltage value corresponding to the respective pixel on the display screen of the liquid crystal display so as to change a display brightness of the respective pixel on the display screen.

By adopting the above starting method of the liquid crystal display, the starting time of the liquid crystal display is effectively improved.

DETAILED DESCRIPTION OF EXEMPLARY EMBODIMENTS

Figure 1:
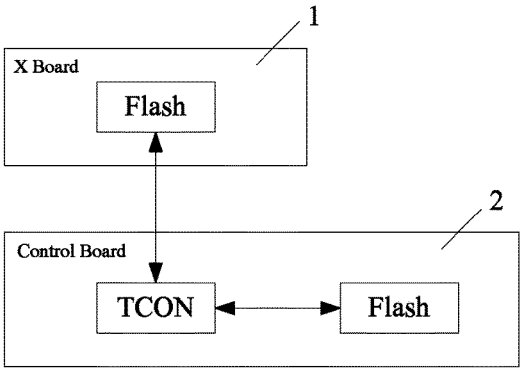
FIG. 1 illustrates a diagram of an inner structure of a liquid crystal display according to an exemplary embodiment of the present disclosure.

A detailed description will now be made to an exemplary embodiment of the present disclosure, an example of the exemplary embodiment is shown in the accompanying drawings, wherein the same reference numerals always indicate the same parts.

FIG. 1 illustrates a diagram of an inner structure of a liquid crystal display according to an exemplary embodiment of the present disclosure. Referring to FIG. 1, a reference numeral 1 is a photoelectronic board (i.e., an X board) of the liquid crystal display, on which a flash memory is provided, and a reference numeral 2 is a control board of the liquid crystal display, on which a timer/counter control register (TCON), which is referred to as a controller for short below, and a flash memory are provided.

Generally, the photoelectronic board and the control board of the liquid crystal display are two independent boards that are manufactured separately, and an operator may debug a display screen of the liquid crystal display when the liquid crystal display leaves a factory, and store, after debugging, a control code for indicating to perform a predetermined screen processing and a corresponding checking code into the flash memory on the photoelectronic board of the liquid crystal display. When a finished product of the liquid crystal display is assembled, the flash memory on the photoelectronic board of the liquid crystal display and the controller on the control board of the liquid crystal display are connected through a flexible flat cable so as to perform a mutual communication; a communication distance between the flash memory and the controller is relatively long, impedance is relatively large, and more interference may occur. The controller on the control board and a flash memory on the control board are also connected through a flexible flat cable to perform a mutual communication, but a communication distance between the controller and the flash memory is relatively short, the impedance is relatively small, and less interference may occur.

Figure 2:
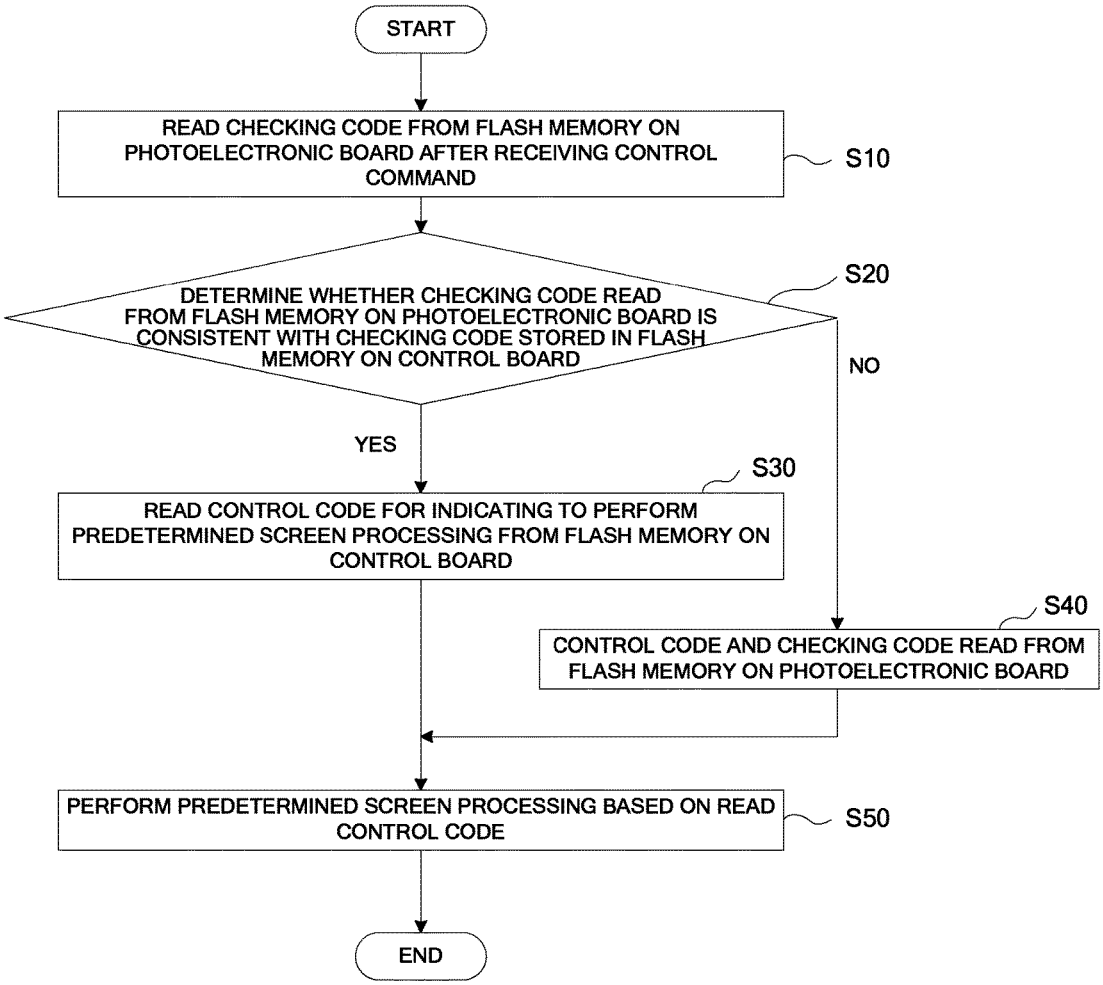
FIG. 2 illustrates a block diagram of a starting method of a liquid crystal display according to an exemplary embodiment of the present disclosure.

FIG. 2 illustrates a block diagram of a starting method of a liquid crystal display according to an exemplary embodiment of the present disclosure.

Referring to FIG. 2, in step S10, after receiving a control command for starting the liquid crystal display, a checking code of a control code for indicating to perform a predetermined screen processing is read from a flash memory on a photoelectronic board of the liquid crystal display.

Alternately, as an example, a control command for starting the liquid crystal display may be generated according to a user input. For example, the user input may include: a selection operation performed by the user on a starting button on a display panel of the liquid crystal display, or a selection operation performed by the user on a starting button on a remote controller of the liquid crystal display. After receiving the selection operation performed by the user on the above starting button, a corresponding control command for starting the liquid crystal display is generated.

Here, as an example, the predetermined screen processing may include a processing for removing a screen Mura. However, the present disclosure is not limited thereto. Alternately, after receiving the control command for starting the liquid crystal display, the photoelectronic board and the control board of the liquid crystal display are powered up, then the controller on the control board reads the checking code of the control code for indicating to perform the predetermined screen processing from the flash memory on the photoelectronic board of the liquid crystal display.

Alternately, the starting method of the liquid crystal display according to the exemplary embodiment of the present disclosure may also include the following step: before performing Step S10, storing the control code for indicating to perform the predetermined screen processing and a corresponding checking code into the flash memory on the photoelectronic board of the liquid crystal display in advance. Here, when the liquid crystal display leaves the factory, the control code for indicating to perform the predetermined screen processing and the corresponding checking code have already been stored in the flash memory on the photoelectronic board of the liquid crystal display. It should be understood that, various existing methods may be used to generate the checking code corresponding to the control code for indicating to perform the predetermined screen processing.

In Step S20, the checking code read from the flash memory on the photoelectronic board is compared with the checking code of the control code for indicating to perform the predetermined screen processing stored the flash memory on the control board of the liquid crystal display.

If the checking code read from the flash memory on the photoelectronic board is consistent with the checking code stored in the flash memory on the control board, then Step S30 is performed: reading the control code for indicating to perform the predetermined screen processing from the flash memory on the control board. Here, because the controller on the control board reads the control code for indicating to perform the predetermined screen processing from the flash memory on the control board, compared with an existing way in which the controller on the control board reads the control code for indicating to perform the predetermined screen processing from the flash memory on the photoelectronic board, a communication distance for a process of reading the control code is effectively reduced, the interference during a process of transmitting the control code is reduced, and the starting time of the liquid crystal display is shortened.

If the checking code read from the flash memory on the photoelectronic board is inconsistent with the checking code stored in the flash memory on the control board, then Step S40 is performed: reading the control code for indicating to perform the predetermined screen processing from the flash memory on the photoelectronic board, and storing the control code for indicating to perform the predetermined screen processing read from the flash memory on the photoelectronic board and the checking code read from the flash memory on the photoelectronic board into the flash memory on the control board.

In Step S50, the predetermined screen processing is performed based on the read control code for indicating to perform the predetermined screen processing.

Particularly, if the control code for indicating to perform the predetermined screen processing is read from the flash memory on the photoelectronic board, then, in Step S50, the predetermined screen processing is performed based on the control code for indicating to perform the predetermined screen processing read from the flash memory on the photoelectronic board; if the control code for indicating to perform the predetermined screen processing is read from the flash memory on the control board, then, in Step S50, the predetermined screen processing is performed based on the control code for indicating to perform the predetermined screen processing read from the flash memory on the control board.

As an example, in a case in which the predetermined screen processing is a processing for removing the screen Mura, the control code for indicating to perform the predetermined screen processing indicates a voltage value corresponding to a respective pixel on a display screen of the liquid crystal display, then accordingly, in Step S50, a flip angle of a liquid crystal molecule is adjusted according to the voltage value corresponding to the respective pixel on the display screen of the liquid crystal display so as to change a display brightness of the respective pixel on the display screen. Here, it should understood that, the method of adjusting the flip angle of the liquid crystal molecule according to the voltage value corresponding to the respective pixel on the display screen of the liquid crystal display so as to change the display brightness of the respective pixel on the display screen, belongs to the common knowledge in the art, and such content will not be repeated in the present disclosure.

A step of performing the starting method as mentioned in the exemplary embodiment of the present disclosure for the first time is described in detail below with reference to FIG. 3.

Figure 3:
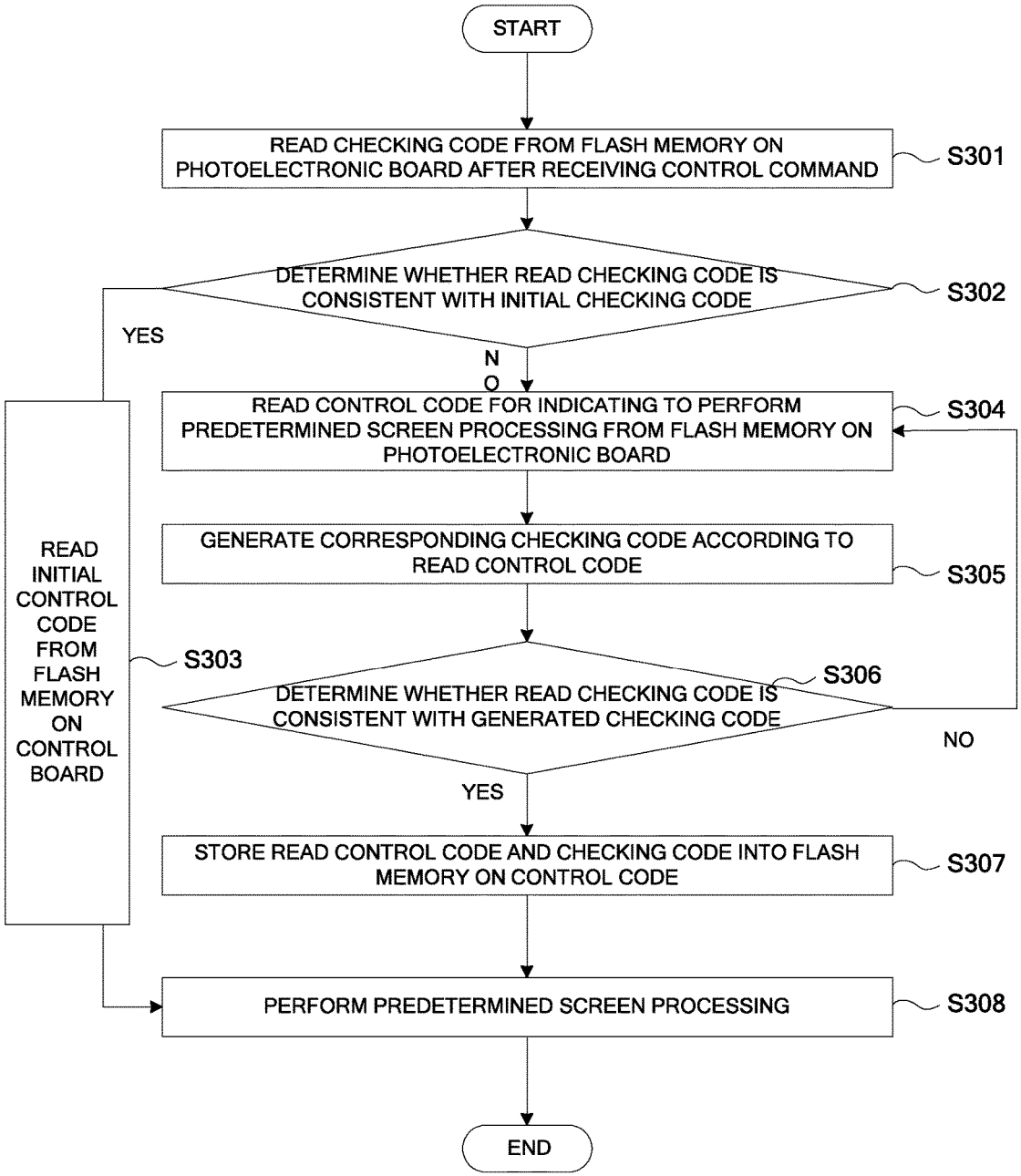
FIG. 3 illustrates a flowchart of a step of reading a control code and a corresponding checking code from a flash memory on a photoelectronic board when performing the starting method in FIG. 1 for the first time according to an exemplary embodiment of the present disclosure.

FIG. 3 illustrates a flowchart of a step when performing the starting method of the liquid crystal display for the first time according to an exemplary embodiment of the present disclosure.

Referring to FIG. 3, in Step S301, after receiving a control command for starting the liquid crystal display, a checking code of a control code for indicating to perform a predetermined screen processing is read from a flash memory on a photoelectronic board of the liquid crystal display.

Here, Step S301 in FIG. 3 is identical with Step S10 in FIG. 2, and is not be repeated.

In Step S302, the checking code of the control code for indicating to perform the predetermined screen processing read from the flash memory on the photoelectronic board of the liquid crystal display is compared with an initial checking code stored in the flash memory on the control board of the liquid crystal display.

Alternately, the starting method of the liquid crystal display according to the exemplary embodiment of the present disclosure may also include the following step: before performing Step S302, storing an initial control code for indicating to perform the predetermined screen processing and an corresponding initial checking code into the flash memory on the control board of the liquid crystal display in advance.

If the checking code read from the flash memory on the photoelectronic board is consistent with the initial checking code stored in the flash memory on the control board, then Step S303 is performed: reading the initial control code for indicating to perform the predetermined screen processing from the flash memory on the control board of the liquid crystal display. As an example, in a case in which the predetermined screen processing is a processing for removing the screen Mura, the initial checking code may indicate that a Mura phenomenon does not exist on the display screen of the liquid crystal display, at this time if the checking code read from the flash memory on the photoelectronic board is inconsistent with the initial checking code, then it is indicated that it is unnecessary to adjust a display brightness of the respective pixel on the display screen.

If the checking code read from the flash memory on the photoelectronic board is inconsistent with the initial checking code stored in the flash memory on the control board, then Step S304 is performed: reading the control code for indicating to perform the predetermined screen processing from the flash memory on the photoelectronic board.

In Step S305, the corresponding checking code is generated according to the control code for indicating to perform the predetermined screen processing read from the photoelectronic board. Here, various existing methods may be used to generate the corresponding checking code according to the read control code for indicating to perform the predetermined screen processing.

In Step S306, the checking code read from the flash memory on the photoelectronic board is compared with the generated checking code.

If the checking code read from the flash memory on the photoelectronic board is inconsistent with the generated checking code, then Step S304 is returned to and performed, to re-read the control code for indicating to perform the predetermined screen processing from the flash memory on the photoelectronic board.

If the checking code read from the flash memory on the photoelectronic board is consistent with the generated checking code, then Step S307 is performed: storing both the control code for indicating to perform the predetermined screen processing read from the flash memory on the photoelectronic board and the checking code read from the flash memory on the photoelectronic board into the flash memory on the control board.

In Step S308, the predetermined screen processing is performed.

Particularly, if the control code for indicating to perform the predetermined screen processing is read from the flash memory on the photoelectronic board, then, in Step S308, the predetermined screen processing is performed based on the read control code for indicating to perform the predetermined screen processing; if the initial control code for indicating to perform the predetermined screen processing is read from the flash memory on the control board, then, in Step S308, the predetermined screen processing is performed based on the read initial control code for indicating to perform the predetermined screen processing.

Alternately, in a case in which the predetermined screen processing is a processing for removing the screen Mura, the initial control code for indicating to perform the predetermined screen processing may indicate an initial voltage value corresponding to a respective pixel on the display screen of the liquid crystal display. Therefore, in Step S308, the display brightness of the respective pixel on the display screen is controlled according to the initial voltage value corresponding to the respective pixel on the display screen of the liquid crystal display.

By adopting the starting method of the liquid crystal display of the exemplary embodiment of the present disclosure, the control code for indicating to perform the predetermined screen processing is needed to be read from the flash memory on the photoelectronic board only when performing the starting method for the first time, and after that, only the checking code of the control code for indicating to perform the predetermined screen processing is needed to be read from the flash memory on the photoelectronic board, effectively reducing communication time, thereby improving the starting time of the liquid crystal display. In addition, when the checking code is consistently matched, the controller reads the control code for indicating to perform the predetermined screen processing from the flash memory on the control board. Because the controller and the flash memory on the control board are located on the same printed circuit board (PCB), thus the communication distance is short, the impedance is small, and less interference may occur.

Figure 4:
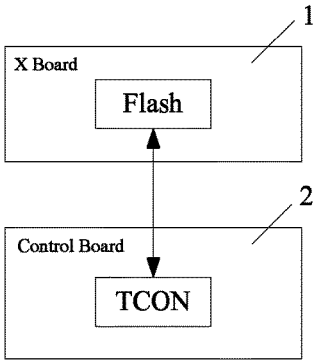
FIG. 4 illustrates a diagram of an inner structure of a liquid crystal display according to another exemplary embodiment of the present disclosure.

FIG. 4 illustrates a diagram of an inner structure of a liquid crystal display according to another exemplary embodiment of the present disclosure. Referring to FIG. 4, a reference numeral 1 is a photoelectronic board (i.e., an X board) of the liquid crystal display, on which a flash memory is provided, and a reference numeral 2 is a control board of the liquid crystal display, on which a flash memory is provided.

Generally, in the starting method of the liquid crystal display according to another exemplary embodiment of the present disclosure, after receiving the control command for starting the liquid crystal display, m pieces of control codes for indicating to perform the predetermined screen processing are sequentially read from the flash memory on the photoelectronic board of the liquid crystal display, then the predetermined screen processing is performed based on the read m pieces of control codes for indicating to perform the predetermined screen processing.

A step of the starting method of the liquid crystal display according to another exemplary embodiment of the present disclosure is described in detail below with reference to FIG. 5.

Figure 5:
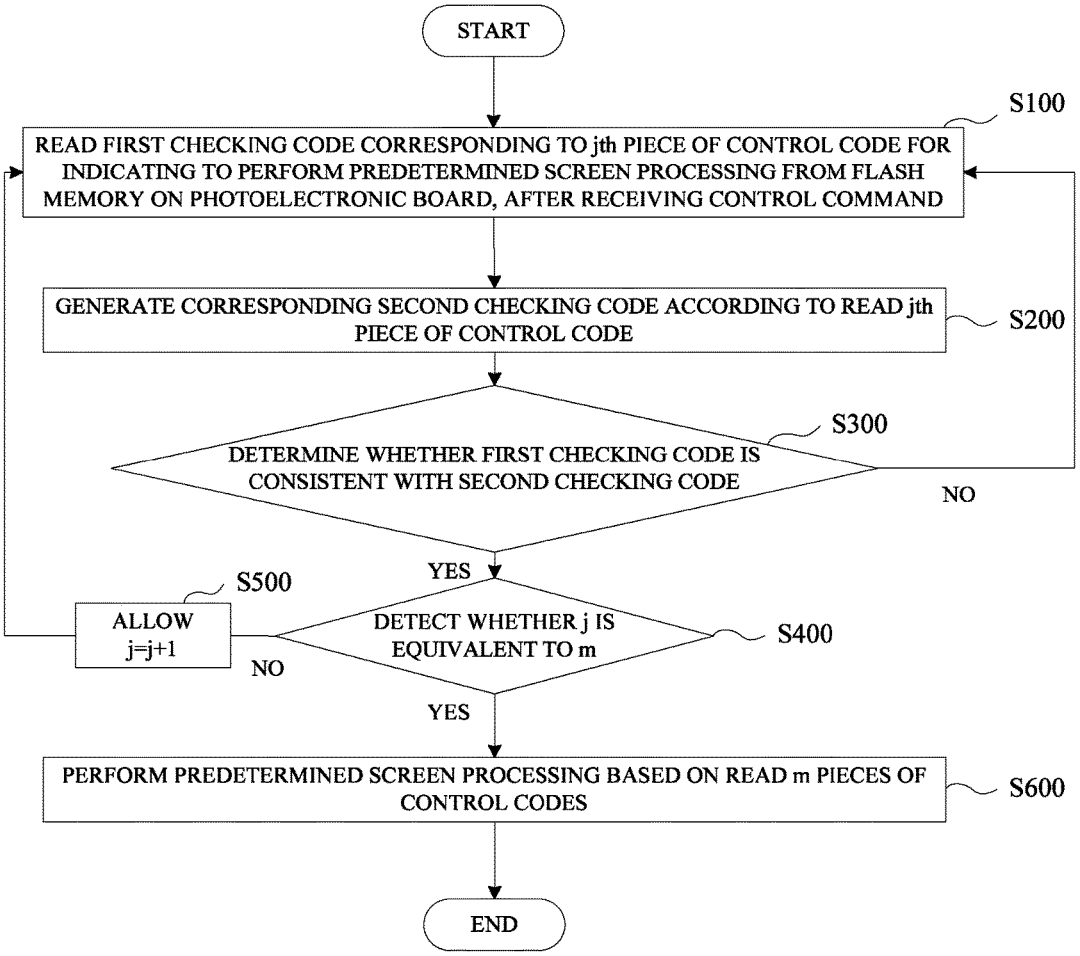
FIG. 5 illustrates a flowchart of a starting method of a liquid crystal display according to another exemplary embodiment of the present disclosure.

FIG. 5 illustrates a flowchart of a starting method of a liquid crystal display according to another exemplary embodiment of the present disclosure.

In Step S100, after receiving the control command for starting the liquid crystal display, the jth piece of control code for indicating to perform the predetermined screen processing from the m pieces of control codes for indicating to perform the predetermined screen processing and a first checking code corresponding to the jth piece of control code for indicating to perform the predetermined screen processing are read from the flash memory on the photoelectronic board of the liquid crystal display. Alternately, here the read jth piece of control code for indicating to perform the predetermined screen processing and the corresponding first checking code may be stored into a memory of the controller on the control board of the liquid crystal display. Here, as an example, an initial value of j is 1, $j \in [1, m]$, and m is a natural number larger than 0.

Alternately, as an example, a control command for starting the liquid crystal display may be generated according to a user input. For example, the user input may include: a selection operation performed by a user on a starting button on a display panel of the liquid crystal display, or a selection operation performed by the user on a starting button on a remote controller of the liquid crystal display. After receiving the selection operation performed by the user on the above starting button, a corresponding control command for starting the liquid crystal display is generated.

Here, as an example, the predetermined screen processing may include a processing for removing a screen Mura. However, the present disclosure is not limited thereto. Alternately, the starting method of the liquid crystal device according to another exemplary embodiment of the present disclosure may further include the following step: before performing Step S100, dividing the control code for indicating to perform the predetermined screen processing into m pieces; generating the corresponding m checking codes respectively with respect to the m pieces of control codes for indicating to perform the predetermined screen processing; storing the m pieces of control codes for indicating to perform the predetermined screen processing and the generated m checking codes into the flash memory on the photovoltaic board of the liquid crystal display. Here, when the liquid crystal display leaves the factory, m pieces of control codes for indicating to perform the predetermined screen processing and m corresponding checking codes have already been stored in the flash memory on the photoelectronic board of the liquid crystal display. It should be understood that, various existing methods may be used to generate the checking code corresponding to the control code for indicating to perform the predetermined screen processing.

In step S200, a corresponding second checking code is generated according to the read jth piece of control code for indicating to perform the predetermined screen processing. Here, various existing methods may be used to generate the corresponding checking code according to the read control code for indicating to perform the predetermined screen processing.

In step S300, the first checking code of the jth piece of the control code for indicating to perform the predetermined screen processing read from the flash memory on the photoelectronic board is compared with the generated second checking code of the jth piece of control code for indicating to perform the predetermined screen processing.

If the first checking code is inconsistent with the second checking code, then Step S100 is returned to and performed. Here, if the first checking code is inconsistent with the second checking code, then it is indicated that an error exists in the jth piece of control code for indicating to perform the predetermined screen processing read by the controller on the control board from the flash memory on the photoelectronic board, thus Step S100 is needed to be returned to and performed to re-read the jth piece of control code for indicating to perform the predetermined screen processing from the flash memory on the photoelectronic board.

If the first checking code is consistent with the second checking code, then Step S400 is executed: detecting whether j is equivalent to m.

When $j \neq m$, Step S500 is performed: allowing $j=j+1$, and returning to perform Step S100.

When $j=m$, it is indicated that the controller on the control board has read all the m pieces of control code for indicating to perform the predetermined screen processing from the flash memory on the photoelectronic board, then in Step S600, the predetermined screen processing is performed based on the read m pieces of control code for indicating to perform the predetermined screen processing.

Alternately, in a case in which the predetermined screen processing is a processing for removing the screen Mura, the m pieces of control code for indicating to perform the predetermined screen processing indicate the voltage value corresponding to the respective pixel on the display screen of the liquid crystal display; then, accordingly, in Step S600, a flip angle of a liquid crystal molecule is adjusted according to the voltage value corresponding to the respective pixel on the display screen of the liquid crystal display so as to change a display brightness of the respective pixel on the display screen. Here, it should understood that, the method of adjusting the flip angle of the liquid crystal molecule according to the voltage value corresponding to the respective pixel on the display screen of the liquid crystal display so as to change the display brightness of the respective pixel on the display screen, belongs to the common knowledge in the art, and such content will not be repeated in the present disclosure.

Here, it should understood that, FIG. 5 illustrates a flowchart of the starting method of the liquid crystal display in a case in which the initial value of j is 1. However, the present disclosure is not limited thereto, and the initial value of j may also be m, at this time, accordingly in Step S400, whether j is equivalent to 0 is detected; when $j \neq 0$, then in Step S500, $j=j-1$ is allowed and Step S100 is returned to and performed; when $j=0$, it is indicated that the controller on the control board has read all the m pieces of control code for indicating to perform the predetermined screen processing from the flash memory on the photoelectronic board, then Step S600 is proceeded.

By adopting the starting method of the liquid crystal display of the exemplary embodiment of the present disclosure, the control code for indicating to perform the predetermined screen processing may be read in pieces from the flash memory on the photoelectronic board; whenever the first checking code corresponding to any piece of control code is inconsistent with the second checking code, only this piece of control code for indicating to perform the predetermined screen processing is needed to be repeatedly read, and it is unnecessary to re-read all the control codes for indicating to perform the predetermined screen processing, thereby effectively saving the starting time of the liquid crystal display.

While the present disclosure has been described taken in conjunction with the specific exemplary embodiments, the implementation of the present disclosure is not limited thereto. Various modifications and variations may be made by those skilled in the art within the scope and spirit of the present disclosure, and these modifications and variations will fall within the protection scope defined in the claims.

What is claimed:

1. A starting method of a liquid crystal display, comprising:

(a) after receiving a control command for starting the liquid crystal display, reading a first checking code of a control code for indicating to perform a predetermined screen processing from a flash memory on a photoelectronic board of the liquid crystal display;

(b) comparing the first checking code read from the flash memory on the photoelectronic board with a second checking code of the control code for indicating to perform the predetermined screen processing stored in a flash memory on the a control board of the liquid crystal display;

(c) if the first checking code read from the flash memory on the photoelectronic board is consistent with the second checking code stored in the flash memory on the control board, then reading the control code for indicating to perform the predetermined screen processing from the flash memory on the control board;

(d1) if the first checking code read from the flash memory on the photoelectronic board is inconsistent with the second checking code stored in the flash memory on the control board, then (d2) reading the control code for indicating to perform the predetermined screen processing from the flash memory on the photoelectronic board, (d3) generating a corresponding checking code according to the read control code for indicating to perform the predetermined screen processing, (d4) comparing the first checking code read from the flash memory on the photoelectric board with the generated checking code, (d5) if the read checking code is inconsistent with the generated checking code, then returning to and performing Step (d2), and (d6) if the read checking code is consistent with the generated checking code, then storing both the control code for indicating to perform the predetermined screen processing read from the flash memory on the photoelectronic board and the first checking code read from the flash memory on the photoelectronic board into the flash memory on the control board; and (e) performing the predetermined screen processing based on the read control code for indicating to perform the predetermined screen processing.

2. The starting method of claim 1, further including: before Step (a), storing the control code for indicating to perform the predetermined screen processing and a corresponding checking code into the flash memory on the photoelectronic board of the liquid crystal display in advance.

3. The starting method of claim 1, further including: storing an initial control code for indicating to perform the predetermined screen processing and a corresponding initial checking code into the flash memory on the control board of the liquid crystal display in advance, wherein when performing the starting method for a first time, Step (b) comprises: comparing the first checking code read from the flash memory on the photoelectronic board with an initial checking code stored in the flash memory on the control board of the liquid crystal display.

4. The starting method of claim 1, wherein the predetermined screen processing is a processing for removing a screen Mura.

5. The starting method of claim 4, wherein the control code for indicating to perform the predetermined screen processing indicates a voltage value corresponding to a respective pixel on a display screen of the liquid crystal display, wherein Step (e) comprises:

adjusting a flip angle of a liquid crystal molecule according to the voltage value corresponding to the respective pixel on the display screen of the liquid crystal display so as to change a display brightness of the respective pixel on the display screen.

6. A starting method of a liquid crystal display, comprising:

(a) after receiving a control command for starting the liquid crystal display, sequentially reading m pieces of control codes for indicating to perform a predetermined screen processing read from a flash memory on a photoelectronic board of the liquid crystal display; and (b) performing the predetermined screen processing based on the read m pieces of control codes for indicating to perform the predetermined screen processing, wherein reading any piece of control code for indicating to perform the predetermined screen processing from the flash memory on the photoelectronic board of the liquid crystal display comprises:

(a1) reading the one piece of control code for indicating to perform the predetermined screen processing and a first checking code corresponding to the one piece of control code for indicating to perform the predetermined screen processing from the flash memory on the photoelectronic board of the liquid crystal display;

(a2) generating a corresponding second checking code according to the read one piece of control code for indicating to perform the predetermined screen processing;

(a3) comparing the first checking code with the second checking code;

(a4) if the first checking code is inconsistent with the second checking code, then returning to and performing Step (a1); and (a5) if the first checking code is consistent with the second checking code, then taking the one piece of control code for indicating to perform the predetermined screen processing read from the flash memory on the photoelectronic board of the liquid crystal display as one of the m pieces of control code for indicating to perform the predetermined screen processing in Step (b).

7. The starting method of claim 6, further comprising: before Step (a), dividing the control code for indicating to perform the predetermined screen processing into m pieces;

generating corresponding m checking codes respectively with respect to the m pieces of control codes for indicating to perform the predetermined screen processing; and storing the m pieces of control codes for indicating to perform the predetermined screen processing and the generated m checking codes into the flash memory on the photoelectronic board of the liquid crystal display.

8. The starting method of claim 6, wherein the predetermined screen processing is a processing for removing a screen Mura.

9. The starting method of claim 8, wherein the control code for indicating to perform the predetermined screen processing indicates a voltage value corresponding to a respective pixel on a display screen of the liquid crystal display, wherein Step (b) further comprises:

adjusting a flip angle of a liquid crystal molecule according to the voltage value corresponding to the respective pixel on the display screen of the liquid crystal display so as to change a display brightness of the respective pixel on the display screen.

* * * * *